US011655945B2

(12) United States Patent
Liu

(10) Patent No.: US 11,655,945 B2
(45) Date of Patent: May 23, 2023

(54) LED LAMP STRIP CAPABLE OF BEING BENT IN MULTIPLE DIRECTIONS AND LAMP STRING STRUCTURE THEREFOR

(71) Applicants: SHENZHEN CLEAR LIGHTING CO., LTD., Guangdong (CN); HUIZHOU CLEAR LIGHTING CO., LTD., Guangdong (CN)

(72) Inventor: Changgui Liu, Shenzhen (CN)

(73) Assignees: SHENZHEN CLEAR LIGHTING CO., LTD., Guangdong (CN); HUIZHOU CLEAR LIGHTING CO., LTD., Guangdong (CN)

( * ) Notice: Subject to any disclaimer, the term of this patent is extended or adjusted under 35 U.S.C. 154(b) by 0 days.

(21) Appl. No.: 17/885,526

(22) Filed: Aug. 10, 2022

(65) Prior Publication Data

US 2022/0381409 A1 Dec. 1, 2022

Related U.S. Application Data

(63) Continuation of application No. PCT/CN2021/100774, filed on Jun. 18, 2021.

(30) Foreign Application Priority Data

Jul. 1, 2020 (CN) ..... 202010620708.2

(51) Int. Cl.

| | |
|---|---|
| ***F21S 4/22*** | (2016.01) |
| ***F21V 23/00*** | (2015.01) |
| *F21Y 115/10* | (2016.01) |

(52) U.S. Cl.

CPC ..... *F21S 4/22* (2016.01); *F21V 23/001* (2013.01); *F21V 23/004* (2013.01); *F21Y 2115/10* (2016.08)

(58) Field of Classification Search

CPC ..... F21V 23/004; F21V 23/001; F21S 4/22; F21S 4/20

See application file for complete search history.

(56) References Cited

U.S. PATENT DOCUMENTS

| | | | | |
|---|---|---|---|---|
| 10,520,143 | B1 * | 12/2019 | Findlay | F21V 31/04 |
| 2014/0265809 | A1 * | 9/2014 | Hussell | H05K 1/142 313/3 |
| 2019/0051803 | A1 * | 2/2019 | Kums | H05K 1/189 |
| 2019/0277462 | A1 * | 9/2019 | Monestier | F21S 4/24 |
| 2019/0279969 | A1 * | 9/2019 | Mülders | H05B 45/00 |

* cited by examiner

*Primary Examiner* — Evan P Dzierzynski
*Assistant Examiner* — Nathaniel J Lee
(74) *Attorney, Agent, or Firm* — Leong C. Lei

(57) ABSTRACT

An LED lamp strip capable of being bent in multiple directions and an LED lamp string structure therefor. The LED lamp string structure comprises: a plurality of LED lamp strings, wherein each LED lamp string at least includes an LED light source, an electronic component and a connecting component; head-tail connecting components of the LED lamp strings are connected between two main wires of an LED lamp strip core wire in parallel; and at least one main wire has a spiral curve structure.

11 Claims, 13 Drawing Sheets

LED LAMP STRIP CAPABLE OF BEING BENT IN MULTIPLE DIRECTIONS AND LAMP STRING STRUCTURE THEREFOR

RELATED APPLICATIONS

This application is a continuing application of PCT Patent Application Number PCT/CN2021/100774, entitled LED LAMP STRIP CAPABLE OF BEING BENT IN MULTIPLE DIRECTIONS AND LAMP STRING STRUCTURE THEREFOR, filed on Jun. 18, 2021, which claims priority to China Patent Application No. 202010620708.2 filed on Jul. 1, 2020, both of which are hereby incorporated in its entireties by reference.

FIELD OF THE INVENTION

Embodiments of the present disclosure relate to light-emitting diode (LED) lighting field, and more particularly to an LED light strip bendable in multiple directions and its light string structure.

DISCUSSION OF THE RELATED ART

FIGS. 1 to 4 show an existing flexible light strip. Wherein, FIG. 1 shows a core wire 1' made of soft elastic plastic or silicone. At least two main wires 20' and 21' of the same length as the light strip are preset in the core wire 1'. The two main wires are on the same horizontal line and parallel to the surface of the light strip, and a core wire groove 8' in the middle with the same length as the core wire is reserved. FIG. 2 shows a light string 3' which includes light sources 5', electronic components 6' and connecting wires 7'. The light string 3' will be embedded in the core wire groove 8' shown in FIG. 2, and then the heads and the tails of the light string units are connected in parallel to the main wires 20' and 21' of the core wire 1'. As shown in FIG. 3, usually a light strip is composed of multiple light string units. On the basis of FIG. 3, a layer of soft elastic plastic or silicone 4' encapsulates to form a complete light strip as shown in FIG. 4.

However, the existing light strip can only be top bent (as shown in FIG. 5). If it is side bent, one of the main wires 20' will be compressed, and the other main wire 21' will be stretched. Although the elastic plastic or silicone can be stretched or compressed, the light strip cannot generate enough force to shorten or elongate a main wire, and therefore, this arrangement of main wires prevents the light strip from bending this way.

SUMMARY

The technical problem to be solved by the present invention is to provide an LED light strip bendable in multiple directions and its light string, so as to realize the multi-direction bending of the light strip, and expand the application range and convenience of the product.

To solve above-mentioned technical problem, one aspect of the present invention provides a light string structure, which is used in an LED light strip bendable in multiple directions, comprises: a plurality of light strings, each of which at least contains an LED light source, electronic components, and connecting members for connecting said LED light sources and said electronic components, the heads and the tails of said light strings are connected by said connecting members in parallel to said main wires, wherein at least one main wire has a spiral curve structure.

Advantageously, said connecting member is a connecting wire, and at least part of said connecting wires are a spiral curve structure.

Advantageously, said pluralities of LED light strings are arranged on flexible printed circuit board (FPCB); said FPCB includes a plurality of device soldering areas arranged at intervals, and connection areas between the adjacent device soldering areas; wherein the device soldering area soldered with surface mount device (SMD) LED light sources or/and SMD electronic components, and said connecting members for connecting SMD LED light sources and SMD electronic components are formed in said connection areas; said connecting members for connecting the heads and the tails of the light string are connecting wires.

Advantageously, the connecting members in the connecting area are a curved flexible board connecting structure.

Advantageously, said device soldering areas are rectangular, and at least part of connecting members in the connection areas between adjacent device soldering areas are a zigzag wire connection structure.

Another aspect of the present invention provides an LED light strip bendable in multiple directions comprises:

a core wire having a core wire groove arranged along the direction of said LED light strip in the middle, and at least two main wires arranged close to the sides of said strip core groove in said core wire;

a plurality of light strings arranged in said core wire groove at intervals, which include at least LED light sources, electronic components and connecting members for connecting said LED light sources and said electronic components, and the heads and the tails of said light strings are connected by said connecting members in parallel to said main wires;

an insulating layer wrapped outside said core wire;

wherein, at least one main wire has a spiral curve structure.

Advantageously, said connecting members are said connecting wires, at least part of which are a spiral curve structure.

Advantageously, said plurality of light strings are arranged on FPCB;

said FPCB includes a plurality of device soldering areas arranged at intervals, and connection areas between the adjacent device soldering areas; wherein the device soldering area soldered with SMD LED light sources or/and SMD electronic components, and said connecting members for connecting SMD LED light sources and SMD electronic components are formed in said connection areas; said connecting members for connecting the heads and the tails of the light string units are connecting wires.

Advantageously, said device soldering areas are rectangular, and said connection areas between adjacent device soldering areas are also rectangular but with a smaller width than the width of said device soldering area;

said connecting members in the connection area are a curved flexible board connecting structure.

Advantageously, said device soldering areas are rectangular, and at least part of the connecting members in the connection areas between adjacent device soldering areas are a zigzag wire connection structure.

Advantageously, said core wire and said insulating wrap layer are made of soft plastic or silicone;

Performing the present invention will bring out the following beneficial effects:

In the embodiment of the present invention, the two main wires in the light string adopt a spiral curve structure, which can improve the bending resistance of the light strip, so that it can be bent in multiple directions;

At the same time, when the connecting members connecting the LED light source and the electronic components are connecting wires, some of the connecting wires have a spiral curve structure, which further improves the bending resistance of the light strip, so that it can be bent in multiple directions;

In the light string using FPCB, the connecting members in the connection areas are arranged in a curved soft board connection structure, or in a zigzag wire connection structure, which can also improve the bending resistance of the light strip in different directions.

BRIEF DESCRIPTION OF THE DRAWINGS

In order to more clearly illustrate the embodiments of the present invention or the technical solutions in the prior art, the drawings used in the embodiments or the description of the prior art will be briefly described below. Obviously, the drawings in the following description are only certain embodiments of the present invention, and other drawings can be obtained from those skilled in the art without any creative work.

DETAILED DESCRIPTION OF THE EMBODIMENTS

The technical solutions in the embodiments of the present invention are clearly and completely described below with reference to the accompanying drawings in the embodiments of the present invention. Apparently, the described embodiments are merely a part of but not all embodiments of the present invention. All other embodiments obtained by a person of ordinary skilled in the art based on the embodiments of the present invention without creative efforts shall fall within the protection scope of the present invention.

As shown in FIGS. 6-9, it is the first embodiment of an LED light strip bendable in multiple directions according to the present invention.

Figure 1:
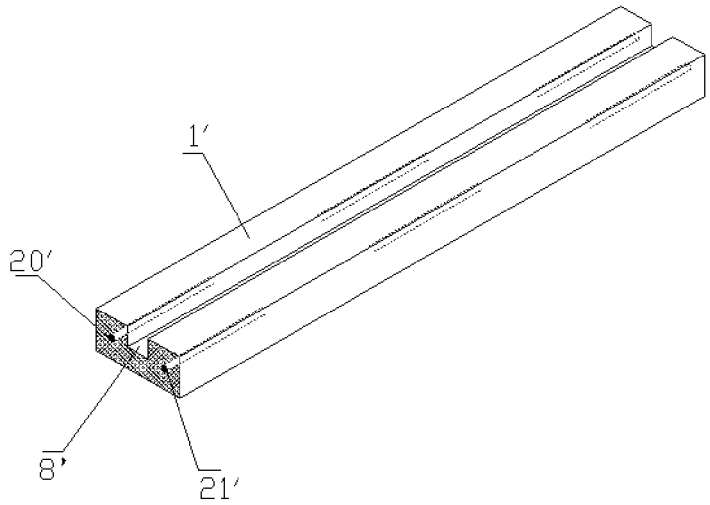
FIG. 1 is a schematic diagram of the core wire structure of an existing flexible light strip.
Figure 2:
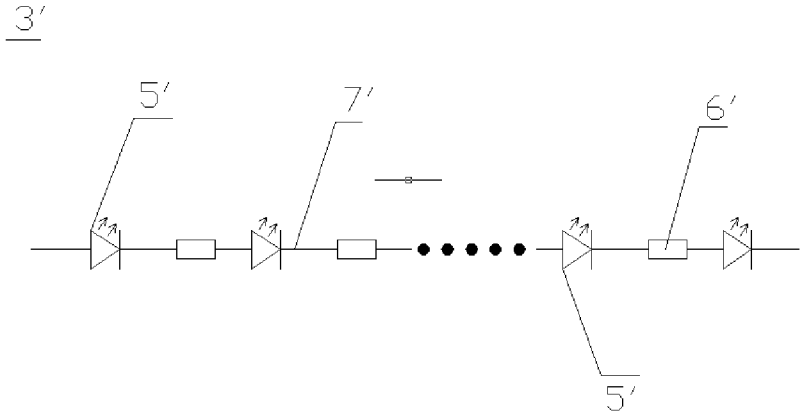
FIG. 2 is a schematic diagram showing the structure of the light string of an existing flexible light strip.
Figure 3:
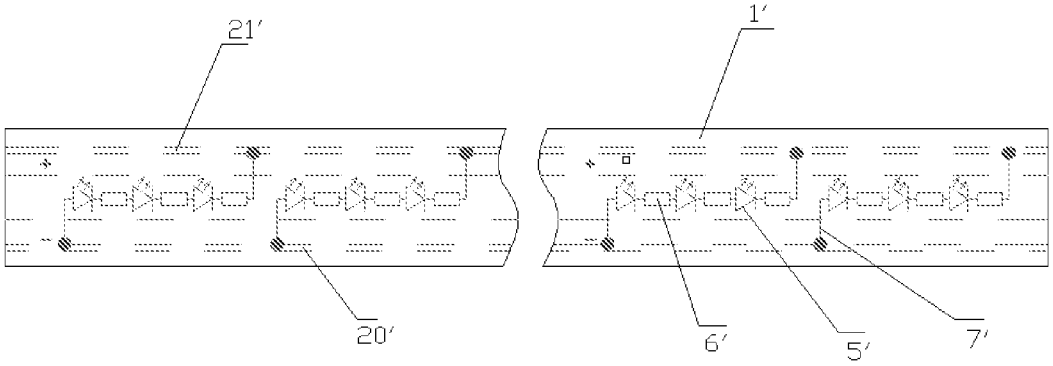
FIG. 3 is a schematic diagram showing the principle of the structure shown in FIG. 1 and FIG. 2 after being assembled.
Figure 4:
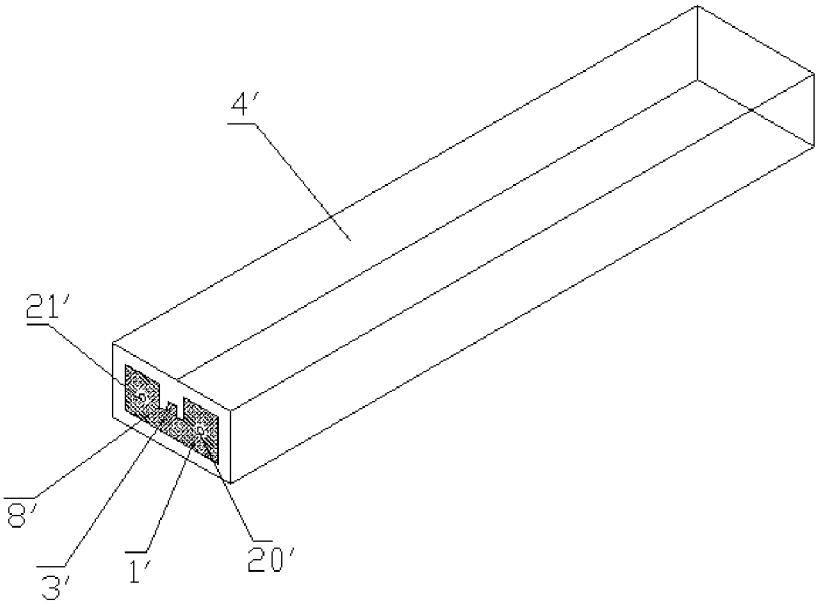
FIG. 4 is a schematic diagram of the structure after being encapsulated by a layer of soft elastic plastic or silicone on the basis of FIG. 3.
Figure 5:
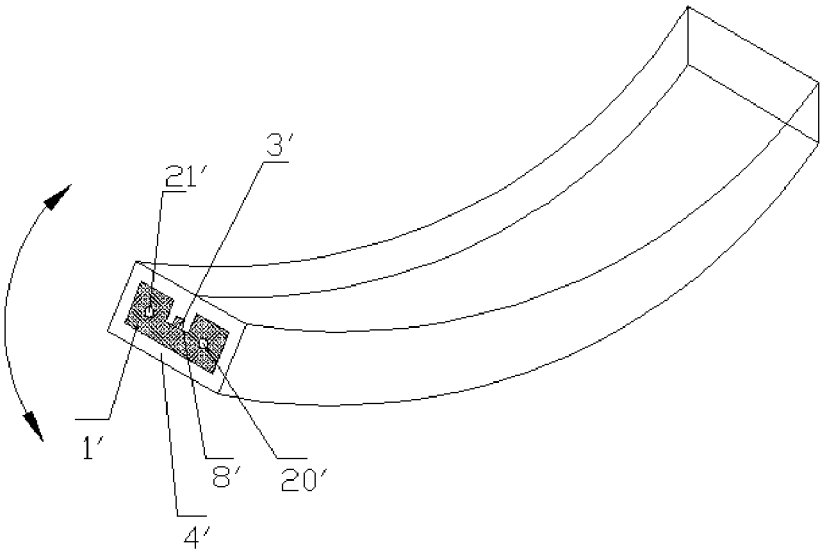
FIG. 5 is a schematic diagram of the structure, shown in FIG. 4, which is top bent.

In this embodiment, the LED light strip bendable in multiple directions includes:

core wire 1 whose cross-section is roughly concave. But it could be understood that it is not limited to this shape in other embodiments. There is a core wire groove 8 arranged along the direction of the light strip in the middle, and at least two main wires are arranged near both sides of the core groove 8 in the core wire. In this embodiment, two main wires 20 and 21 are shown, and it could be understood that more than two main wires may also be used in other embodiments;

a plurality of light strings 3 are arranged in the core wire groove 8 at intervals, and they include at least LED light sources 5, electronic components 6 and connecting members 7 for connecting the LED light sources 5 and the electronic components 6. In this figure, the connecting members 7 are connecting wires, and the heads and the tails of the light strings are connected in parallel by connecting wires to the main wires 20 and 21. In this embodiment, the structure of the light string 3 can be referred to FIG. 2, and the connection between it and the main wires can be referred to FIG. 9;

an insulating wrap layer 4 wrapped outside the core wire 1. The wrapping form of the insulating wrap layer can be referred to FIG. 4.

Figure 6:
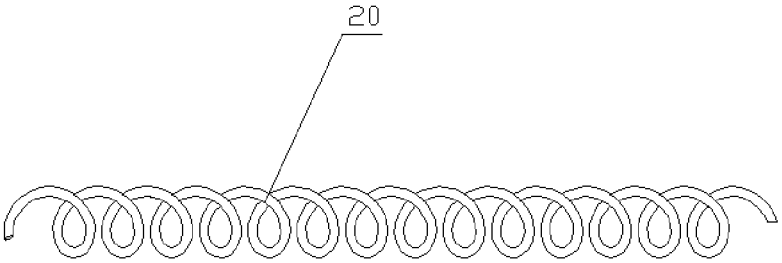
FIG. 6 is a schematic structural diagram of the metal wire used in the first embodiment of the present invention.

The main difference between this embodiment and the prior art is that the two main wires 20 and 21 have a spiral curve structure, specifically, refer to FIG. 6. It could be understood that this is only for illustration, while in an actual product, at least one main wire with a spiral curve structure can be included to improve the technical problems raised in the present application.

In this embodiment, the core wire 1 and the insulating wrapping layer 4 can be made of soft plastic or silicone. The main wires 20 and 21 can be made of copper, aluminum, steel or alloys of the above materials.

Figure 20:
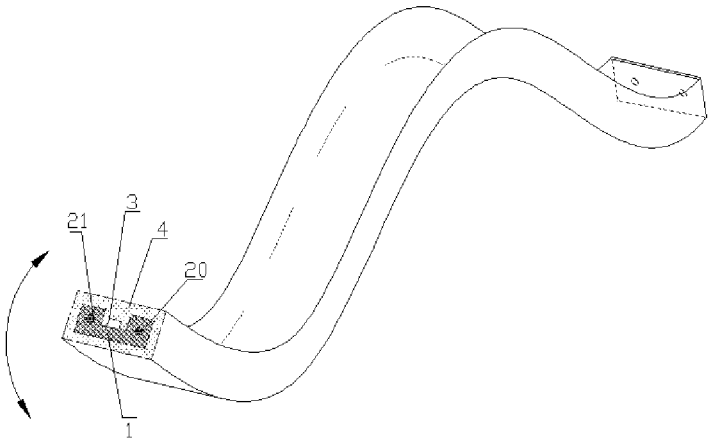
FIG. 20 is a schematic diagram of a bending form of the LED light strip bendable in multiple directions according to the present invention.
Figure 21:
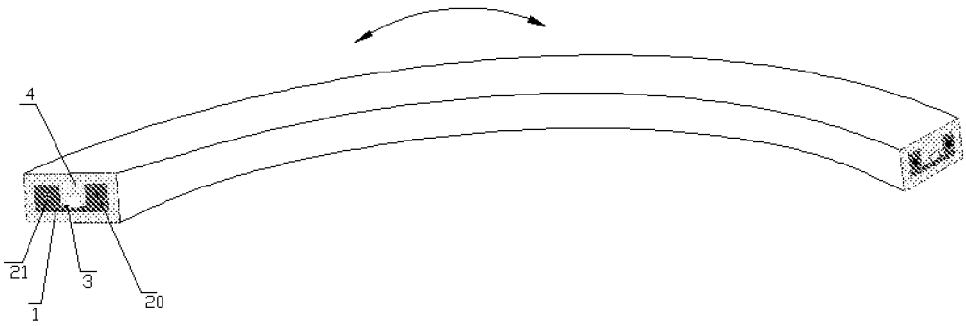
FIG. 21 is a schematic diagram of another bending form of the LED light strip bendable in multiple directions according to the present invention.

Referring to FIGS. 20 to 21 together, what they are shown are respectively the bending schematic diagrams of the LED light strip bendable in multiple directions according to the present invention. It can be seen that the light strip of this structure can be bent in multiple directions, such as bending according to the bending directions of FIGS. 20 and 21. Two of the main wires 20 and 21 have a spiral wire structure, so that when the light strip is bent in any direction, as the elastic plastic or silicone stretches and compresses, the main wires 20 and 21 can also lengthen and shorten like springs without preventing the bending and deformation of the light strip. This embodiment can overcome and improve the problem that the embodiment shown in FIG. 7 can easily reach the tensile limit in a certain bending direction resulting in product failure.

Figure 10:
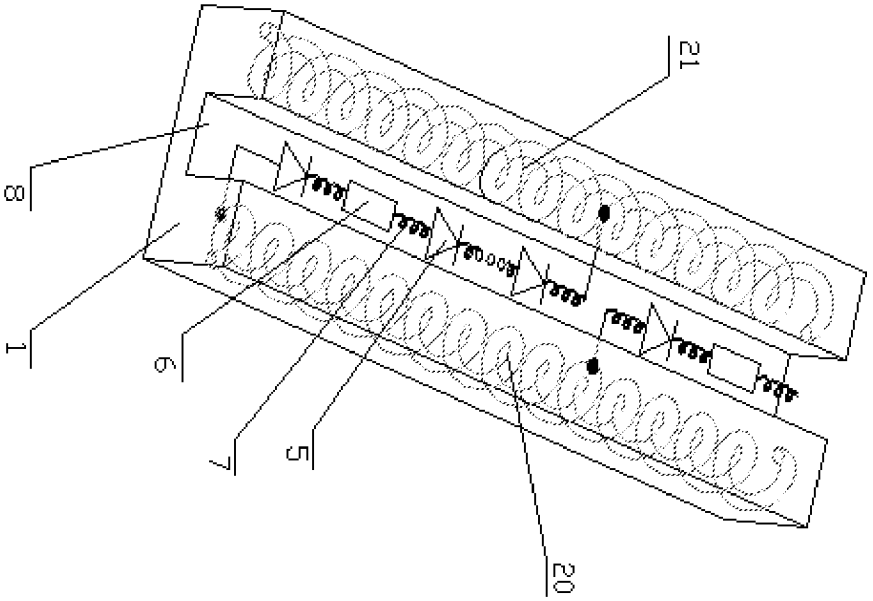
FIG. 10 is a schematic structural diagram of assembling a light string in the core wire of FIG. 7 according to the second embodiment of the present invention.
Figure 11:
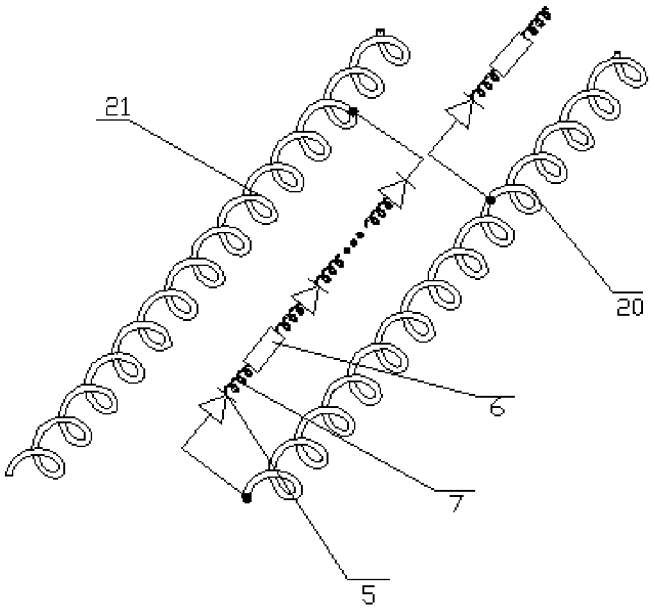
FIG. 11 is a schematic structural diagram of the electrical connection between the light string units and the spiral metal wires according to the second embodiment of the present invention.
Figure 12:
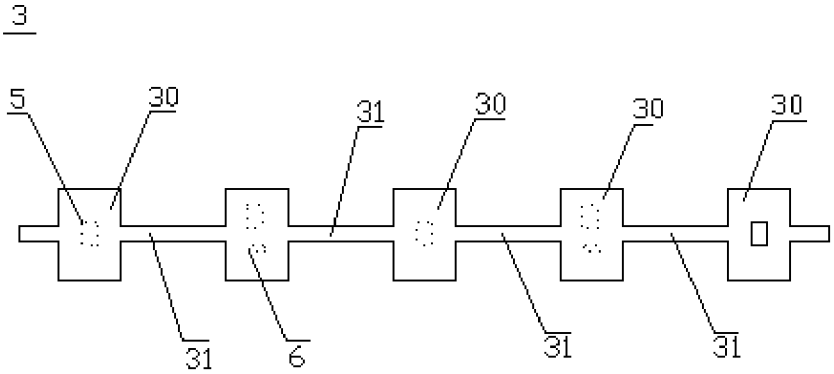
FIG. 12 is a schematic top view of the FPCB light string according to the third embodiment of the third embodiment of the present invention.
Figure 13:
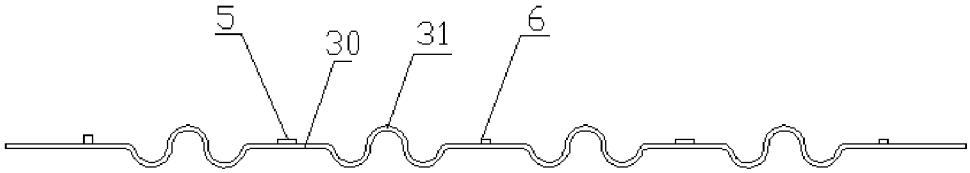
FIG. 13 is a schematic cross-sectional structure diagram of the FPCB light string according to the third embodiment of the present invention.

As shown in FIGS. 10-11, it is the second embodiment of an LED light strip bendable in multiple directions according to the present invention.

Figure 8:
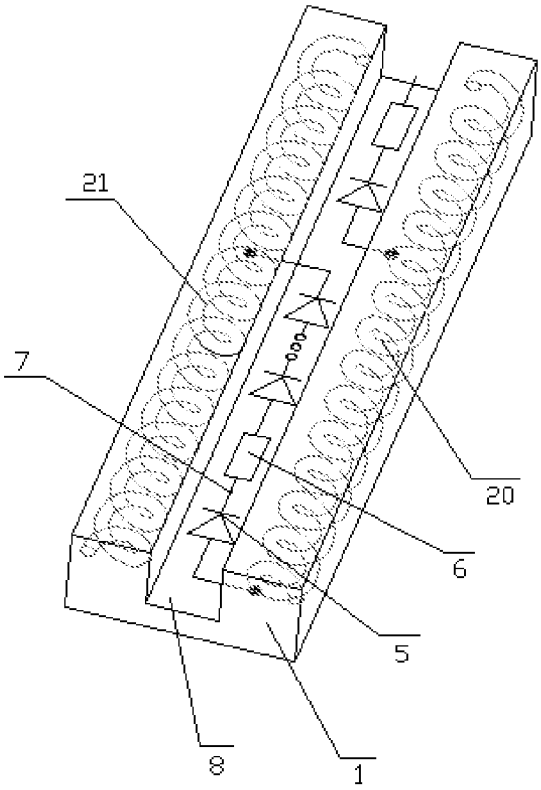
FIG. 8 is a schematic structural diagram of assembling a light string in the core wire of FIG. 7 according to the first embodiment of the present invention.
Figure 9:
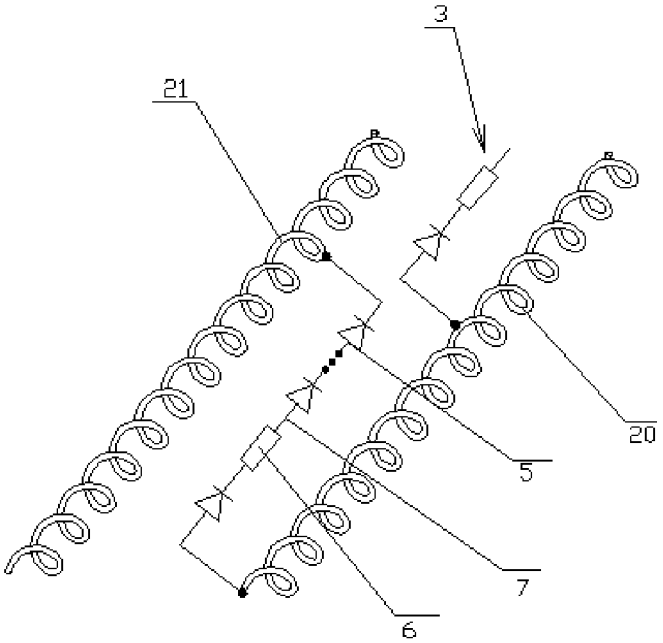
FIG. 9 is a schematic structural diagram of the electrical connection between the light string units and the spiral metal wires according to the first embodiment of the present invention.

In this embodiment, the difference from the structure shown in FIG. 8 lies in the specific structure of the light string. Wherein, the connecting members 7 connecting the light sources 5 and the electronic components 6 are not a straight wire structure in the first embodiment, but a spiral curve structure similar to the structure of the main wires 20 and 21. The effect of this arrangement is: by changing the shape of the connecting members 7, when the light strip is bent in different directions, the light string can better adapt to bending. The LED light strip in this embodiment can be bent according to the bending direction shown in FIGS. 20-21 or more complicated angles without damaging the internal structure of the light strip.

As shown in FIGS. 12-16, it is the third embodiment of an LED light strip bendable in multiple directions according to the present invention.

In this embodiment, the difference from the structure shown in FIG. 8 lies in the specific structure of the light string 3. Wherein, the plurality of light strings are arranged on FPCB and are so called FPCB light strings. Specifically, FPCB includes a plurality of device soldering areas 30 arranged at intervals, and connection areas 31 between adjacent device soldering areas 30; wherein, the device soldering areas 30 are soldered with SMD LED light sources 5 or/and SMD electronics components 6, and connecting members for connecting SMD LED light sources 5 and SMD electronic components 6 are formed in the connection areas. In one example, the device soldering areas 30 are rectangular, and the connection areas 31 between adjacent device soldering areas 30 are also rectangular (for example, in other examples, there may be two or more) but with a width smaller than the width of the device soldering area 30.

In a specific example, the connecting member in the connecting area 31 is a curved flexible board connecting structure.

In this embodiment, the light string formed on FPCB is also connected in parallel to the main wires of the spiral curve structure. Other structures are the same as those shown in the first embodiment and the structure shown in FIG. 7, so it will not be described in detail here.

Figure 14:
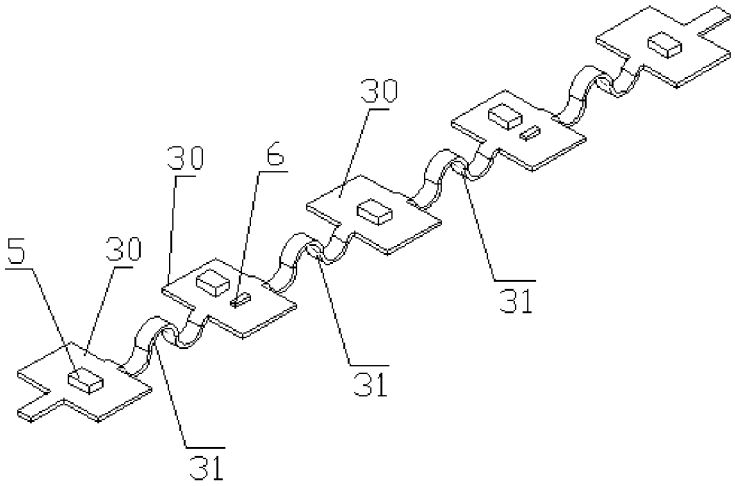
FIG. 14 is a three-dimensional structure diagram of the FPCB light string according to the third embodiment of the present invention.

The using of FPCB makes it easier to make light strings and to design complex circuits. In addition, by making part of FPCB connected by flexible boards, the bending resistance of the light strip can be further improved. In a specific implementation, the light string structure shown in FIG. 14 is placed in the core wire shown in FIG. 7 and the electrical connection with the spiral metal wires is completed to form the assembly structure shown in FIG. 15. Wherein, FIG. 16 further illustrates the electrical connection between the FPCB light string and the spiral metal wires. The LED light strip in this embodiment can also be bent according to the bending direction shown in FIGS. 20-21 or more complicated angles without damaging the internal structure of the light strip.

Figure 17:
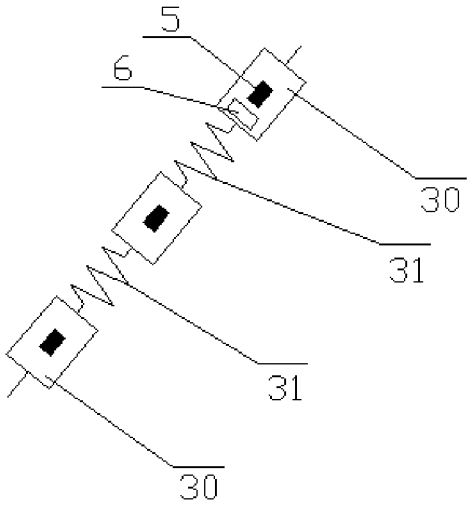
FIG. 17 is a schematic structural diagram of the FPCB light string according to the fourth embodiment of the present invention.
Figure 18:
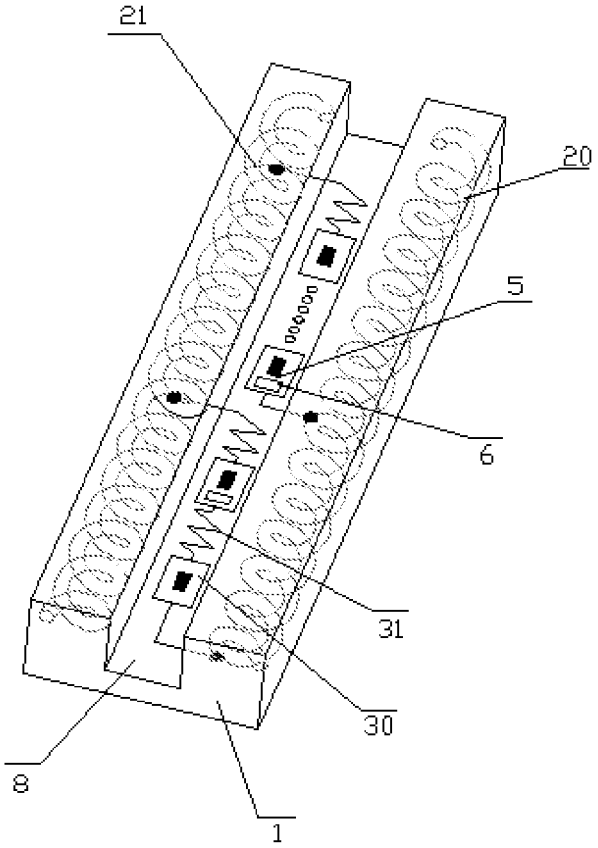
FIG. 18 is a schematic structural diagram of assembling the FPCB light string shown in FIG. 17 in the core wire of FIG. 7 according to the fourth embodiment of the present invention.
Figure 19:
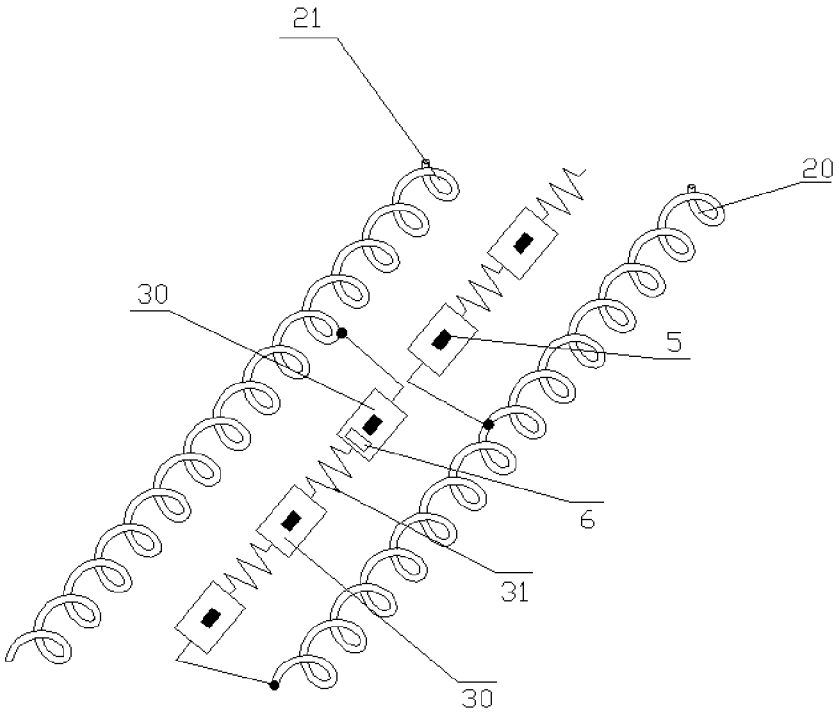
FIG. 19 is a schematic structural diagram of the electrical connection between the FPCB light string units and the spiral metal wires according to the fourth embodiment of the present invention.

As shown in FIGS. 17-19, it is the fourth embodiment of an LED light strip bendable in multiple directions according to the present invention.

Figure 15:
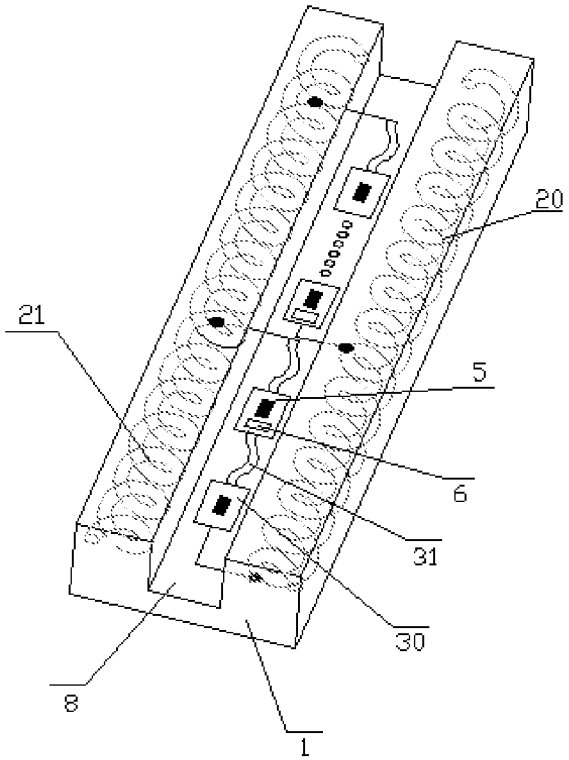
FIG. 15 is a schematic structural diagram of assembling the FPCB light string shown in FIG. 14 in the core wire of FIG. 7 according to the third embodiment of the present invention.
Figure 16:
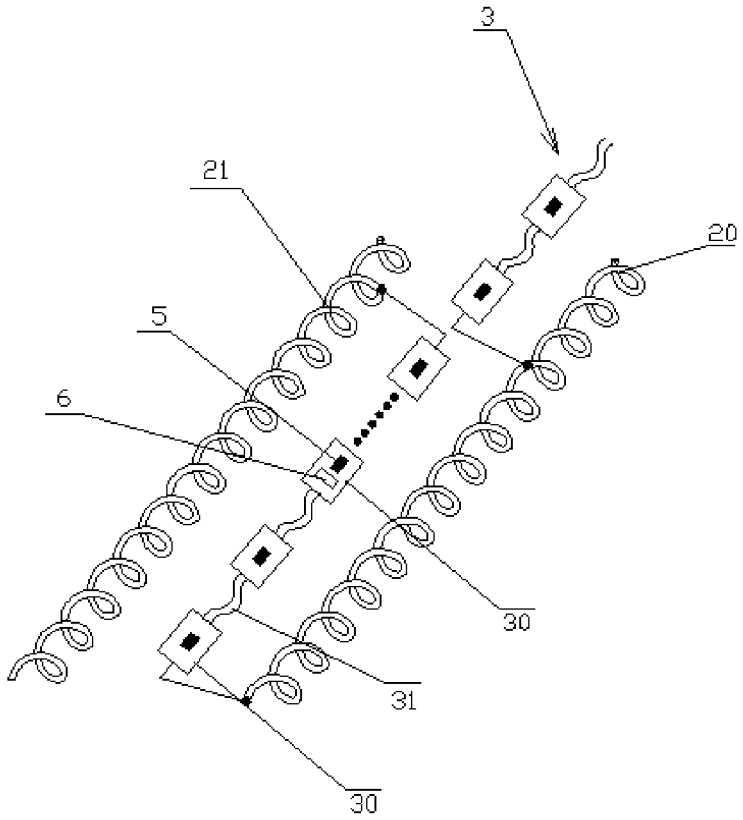
FIG. 16 is a schematic structural diagram of the electrical connection between the FPCB light string units and the spiral metal wires according to the third embodiment of the present invention.

In this embodiment, the difference in structure from FIG. 15 lies in the specific structure of the light string. Specifically, the connection members in the connection areas 31 between adjacent device soldering areas 30 adopt at least one zigzag wire connection structure (for example, in other examples, there may be two or more). The effect of this arrangement is to provide the light string with multi-directional bending without damage to the interior, which is another better structural improvement.

It can be understood that in this embodiment, the light strings formed on FPCB are also connected in parallel to the metal wires of the spiral curve structure. Other structures are the same as those shown in the first embodiment and the structure shown in FIG. 7, so it will not be described in detail here.

Figure 7:
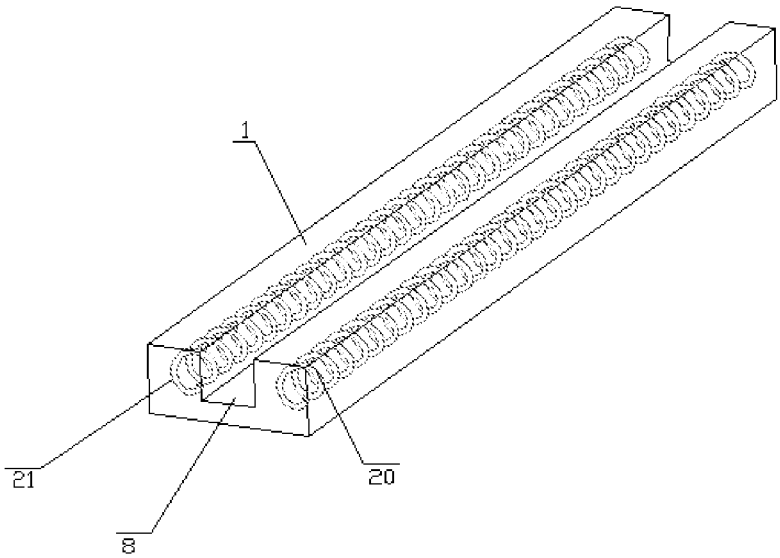
FIG. 7 is a schematic diagram of the core wire according to the first embodiment of the present invention.

In specific implementation, the light string structure shown in FIG. 19 is placed in the core wire shown in FIG. 7 and the electrical connection with the spiral metal wires is completed. FIG. 19 is an exploded schematic diagram of the electrical connection between the FPCB light string and the spiral metal wires.

Likewise, the LED light strip in this embodiment can be bent according to the bending direction shown in FIGS. 20-21 or more complicated angles without damaging the internal structure of the light strip.

It can be understood that, the present invention can only implement the light string structure for the LED light strip that can be bent in multiple directions. The light string structure is implemented in accordance with the light string structures in the second to fourth embodiments above, which can still enable LED light strip bending at more complicated angles without damaging its internal structure. The specific implementations of the light string structure are the same as the above-mentioned implementations, and will not be repeated here.

Performing the present invention will bring out the following beneficial effects:

In the embodiments of the present invention, the two main wires in the light string adopt a spiral curve structure, which can improve the bending resistance of the light strip, so that it can be bent in multiple directions;

At the same time, when the connecting members for connecting the LED light sources and the electronic components are connecting wires, some of the connecting wires have a spiral curve structure, which further improve the bending resistance of the light strip, so that it can be bent in multiple directions;

In the light string using the FPCB, the connecting members in the connection areas are arranged in a curved flexible board connection structure, or in a zigzag wire connection structure, which can also improve the bending resistance of the light strip in different directions.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A light string structure used in a light-emitting diode (LED) light strip bendable in multiple directions, compri comprising: a plurality of light strings, each of which comprises a light string body has a head and a tail and at least contains an LED light source, and electronic components, the heads and the tails of said light strings are connected by connecting members in parallel to main wires, wherein at least one of the main wires has a spiral curve structure, wherein the spiral curve structure is extended in an axial direction that is parallel to an extension direction of the light string body of at least one of the plurality of light strings, such that the spiral curve structure is parallel to the light string body of the at least one light string and is spaced from the light string body of the at least one light string in a direction transverse to the extension direction.

2. The light string structure as claimed in claim 1, wherein said connecting member is a connecting wire, and at least part of said connecting wires are a spiral curve structure.

3. The light string structure as claimed in claim 2, wherein said pluralities of LED light strings are arranged on a flexible printed circuit board (FPCB);

said FPCB includes a plurality of device soldering areas arranged at intervals, and connection areas between the adjacent device soldering areas; wherein the device soldering area soldered with surface mount device (SMD) LED light sources or/and SMD electronic components, and said connecting members for connecting SMD LED light sources and SMD electronic components are formed in said connection areas; said connecting members for connecting the heads and the tails of the light string are connecting wires.

4. The light string structure as claimed in claim 3, wherein the connecting members in the connecting area are a curved flexible board connecting structure.

5. The light string structure as claimed in claim 4, wherein said device soldering areas are rectangular, and at least part of connecting members in the connection areas between adjacent device soldering areas are a zigzag wire connection structure.

6. A light-emitting diode (LED) light strip bendable in multiple directions comprising:

a core wire having a core wire groove arranged along a direction of said LED light strip in a middle of the core wire, and at least two main wires arranged close to sides of said strip core groove in said core wire;

a plurality of light strings arranged in said core wire groove at intervals, which include at least LED light sources, electronic components and connecting members for connecting said LED light sources and said electronic components, each of the plurality of light strings comprising a light string body and a head and a tail, and the heads and the tails of said light strings are connected by said connecting members in parallel to said main wires;

an insulating layer wrapped outside said core wire;

wherein at least one of the main wires has a spiral curve structure, and wherein the spiral curve structure is extended in an axial direction that is parallel to an extension direction of the light string body of at least one of the plurality of light strings, such that the spiral curve structure is parallel to the light string body of the at least one light string and is spaced from the light string body of the at least one light string in a direction transverse to the extension direction.

7. The LED light strip bendable in multiple directions as claimed in claim 6, wherein said connecting members are said connecting wires, at least part of which are a spiral curve structure.

8. The LED light strip bendable in multiple directions as claimed in claim 6, wherein said plurality of light strings are arranged on a flexible printed circuit board (FPCB);

said FPCB includes a plurality of device soldering areas arranged at intervals, and connection areas between the adjacent device soldering areas; wherein the device soldering area soldered with surface mount device (SMD) LED light sources or/and SMD electronic components, and said connecting members for connecting SMD LED light sources and SMD electronic components are formed in said connection areas; said connecting members for connecting the heads and the tails of the light string units are connecting wires.

9. The LED light strip bendable in multiple directions as claimed in claim 8, wherein said device soldering areas are rectangular, and said connection areas between adjacent device soldering areas are also rectangular but with a smaller width than the width of said device soldering area;

said connecting members in the connection area are a curved flexible board connecting structure.

10. The LED light strip bendable in multiple directions as claimed in claim 8, wherein said device soldering areas are rectangular, and at least part of the connecting members in the connection areas between adjacent device soldering areas are a zigzag wire connection structure.

11. The LED light strip bendable in multiple directions as claimed in claim 10, wherein said core wire and said insulating wrap layer are made of soft plastic or silicone;

said main wire is made of copper, aluminum, steel or alloys of the above materials.

* * * * *